United States Patent [19]

Whitwell et al.

[11] Patent Number: 4,492,091

[45] Date of Patent: Jan. 8, 1985

[54] APPARATUS AND METHOD FOR CONTROLLING A HEAT PUMP WATER HEATER

[75] Inventors: Robert J. Whitwell, Baldwinsville; James P. Schafer, Cazenovia, both of N.Y.

[73] Assignee: Carrier Corporation, Syracuse, N.Y.

[21] Appl. No.: 459,296

[22] Filed: Jan. 20, 1983

[51] Int. Cl.[3] ..... F25D 17/00

[52] U.S. Cl. ..... 62/180; 62/238.6; 126/374; 236/20 R; 236/DIG. 6

[58] Field of Search ..... 62/238.6, 180; 219/328; 236/20 R, DIG. 6, DIG. 12; 337/378, 380; 126/437, 362, 374; 374/141, 147

[56] References Cited

U.S. PATENT DOCUMENTS

| | | | |
|---|---|---|---|
| 2,096,697 | 10/1937 | Long . | |
| 2,577,694 | 12/1951 | Winn . | |
| 2,577,902 | 12/1951 | McGrath . | |
| 3,171,387 | 3/1965 | Müller | 122/33 |
| 4,073,285 | 2/1978 | Wendell . | |
| 4,226,606 | 10/1980 | Yaeger et al. . | |
| 4,281,519 | 8/1981 | Spath et al. . | |
| 4,330,309 | 5/1982 | Robinson, Jr. | 62/238.6 |

*Primary Examiner*—William E. Wayner
*Assistant Examiner*—John Sollecito
*Attorney, Agent, or Firm*—Robert H. Kelly

[57] ABSTRACT

A method and apparatus for controlling the operation of an add-on heat pump water heater unit is disclosed. A combination of a thermally conductive tube having a flattened portion and a thermostat mounted thereto is utilized to sense the temperature level of water in a tank to which the heater unit is connected. The tube and thermostat are additionally insulated from the ambient. A circulating pump is provided and connected to the water thermostat such that the pump is energized only when it is necessary to operate the heat energy adding unit.

7 Claims, 3 Drawing Figures

APPARATUS AND METHOD FOR CONTROLLING A HEAT PUMP WATER HEATER

BACKGROUND OF THE INVENTION

1. Field of the Invention

This invention relates to controlling apparatus used for heating water. More particularly, the invention relates to a combination of a heat pump water heater with a separate water storage tank including apparatus and a method for controlling operation of the heat pump water heater in response to the temperature maintained within the storage tank.

2. Prior Art

Heat pump water heaters are known in the art. A heat pump water heater is typically an add-on unit used in addition to an existing electric or oil fired hot water heating unit. The heat pump water heater typically includes a refrigeration circuit having a compressor, condenser, evaporator and expansion device connected to form a refrigeration circuit. The refrigeration circuit is used to transfer heat energy from the air in heat exchange relation with the evaporator to water to be heated in heat exchange relation with the condenser. Water is typically circulated between the hot water tank and the heat pump unit such that a reservoir of heated water is maintained in the tank.

One of the problems of supplying add-on heat pump water heaters is to integrate the controls such that appropriate water temperature levels are maintained within the hot water tank. Often, a separate heating means such as electric resistance heaters or an oil burner for heating the water in the hot water tank is de-energized upon the installation of a heat pump water heater. The purpose of installing a heat pump water heater is to save energy since the amount of electricity required to transfer heat energy using a heat pump is less than the amount of electricity required to heat the water by electric resistance heat or the equivalent amount of oil required for oil heat. Of course, heat pump hot water heaters can be utilized with tanks having no alternate heating source or with gas or propane fired hot water heaters.

One of the problems associated with an add-on unit is that water connections must be made between the hot water tank and the heat pump water heater unit. Additionally, the temperature of the water to be delivered to the enclosure for domestic or other purposes must be maintained at the desired level. In a typical hot water heater a thermal sensing device is integrated with the water heater controls to regulate the electric resistance element or oil burner. This sensing element is usually mechanical in nature and is not suitable for use with an add-on heat pump water heater.

Several methods of integrating the control of a heat pump water heater unit with a hot water tank have been utilized. One method is to mount a temperature sensor on the external wall of the hot water tank. This temperature sensor then detects a temperature which is indicative of the water temperature within the tank. However, the amount of insulation between the tank and the exterior surface to which the sensor is mounted, the location of the sensor on the tank and the heat exchange between the area adjacent to the sensor and the surrounding ambient air all effect the temperature detected. Additionally, Underwriter Labratories, Inc. and certain local code requirements prohibit electrical connections being made to the surface of the tank.

Another method utilized is to continuously operate a circulating pump circulating water from the tank to the heat pump water heater unit. This method allows the water to be constantly monitored by measuring its temperature somewhere along the water flow path. The disadvantage of this type of control is that the pump runs continuously drawing electrical power to circulate the water. Additionally, the temperature stratification desired in the tank to keep the hot water at the top and cold water at the bottom is impaired by the constant circulation of water.

The apparatus and method outlined herein include connecting a thermally conducting tubular member to the tank and mounting a thermal sensing element thereto. The entire assembly is insulated to reduce heat transfer between the tubular member and the thermostat and the ambient air. The thermostat is connected to energize the circulating pump and the refrigeration circuit of the heat pump water heater only when the appropriate temperature conditions are sensed. Hence, the energy utilized to constantly operate the pump motor is reduced to that necessary to operate the circulating pump only when the refrigeration circuit is energized. Additionally, the stratification of the water in the hot water tank is not reduced by continually operating the circulating pump. By providing a thermally conductive member and by insulating that member a temperature is sensed which is representative of the temperature in the tank at that particular point in time.

SUMMARY OF THE INVENTION

An object of the invention is to provide a method and apparatus for controlling a heat pump water heater combined with a hot water storage tank.

Another object of the present invention is to provide a method of accurately sensing a temperature indicative of the temperature level of water in a hot water storage tank.

A further object of the present invention is to provide a control method which operates the circulating pump only when it is desired to provide heat energy to the water storage tank.

It is a further object of the present invention to provide a control method and apparatus which may be easily added on to an existing hot water tank for integrating the hot water tank with a heat pump water heater unit.

A further object of the present invention is to provide a safe, economical, reliable, easy to manufacture and install apparatus for controlling an add-on heat pump water heater.

Other objects will be apparent from the description to follow and from the appended claims.

The preceding objects are achieved according to a water heating system including a tank wherein heated water may be stored and a refrigeration circuit having a compressor, condenser and evaporator wherein the condenser includes a water passageway and a refrigerant passageway in heat exchange relation to transfer heat energy from the refrigerant to the water to be heated. A thermally conductive tubular member extends from the bottom portion of the tank. A first conduit connects the tubular member to the water passageway of the condenser and a second conduit connects the other end of the water passageway of the condenser to the tank at a position spaced from the tubular member.

A pump for circulating water through the first conduit, condenser and through the second conduit is additionally provided. Thermal switching means are mounted to sense the temperature of the tubular member, said thermal sensing means being connected to energize the pump to circulate water and to energize the compressor of the refrigeration circuit when the temperature sensed is below a first threshold temperature and to de-energize the pump and the compressor when the temperature sensed exceeds a second threshold temperature. Additionally insulation is mounted about the temperature sensing means and the thermally conductive tubular member to reduce the heat transfer from the tubular member to the ambient air such that the temperature sensed by the thermal sensing means is an accurate reflection of the temperature of the water in the tank.

A method of controlling a water heating unit including a refrigeration circuit for transferring heat energy to water, a water tank wherein hot water is stored, conduits connecting the water tank to the water heating unit and a circulating pump for routing water through the conduits and between the water tank and the water heating unit is further disclosed. The steps of controlling include sensing the temperature of the water in the tank to determine if the heating unit needs to be energized to supply additional heat energy, said sensing including mounting a thermally conductive tubular member to a drain outlet in the tank as a portion of one of the conduits and detecting the temperature of said member which is representative of the temperature of the water in the tank; energizing a circulating pump to circulate water between the tank and the heating unit only when the step of sensing ascertains the need for supplying additional heat energy to the water; and energizing the refrigeration circuit simultaneously with the step of energizing the pump such that heat energy is supplied to the water.

DESCRIPTION OF THE PREFERRED EMBODIMENT

The embodiment of the invention described below is adapted for use with a heat pump water heater and a storage tank. It is to be understood that the control method and apparatus may be utilized with a refrigeration circuit which additionally supplies cooling or with a refrigerant de-superheater hot water heater or other portion of a refrigeration circuit for heating water. It is additionally to be understood that although the water connections are shown made in certain locations to the water storage tank that the locations may vary with the tank selected and that the drain outlet may be connected through the bottom of the tank or at some other tank location. The pressure and temperature relief valve may additionally be located at the top of the tank as well as on the side of the tank.

Figure 1:
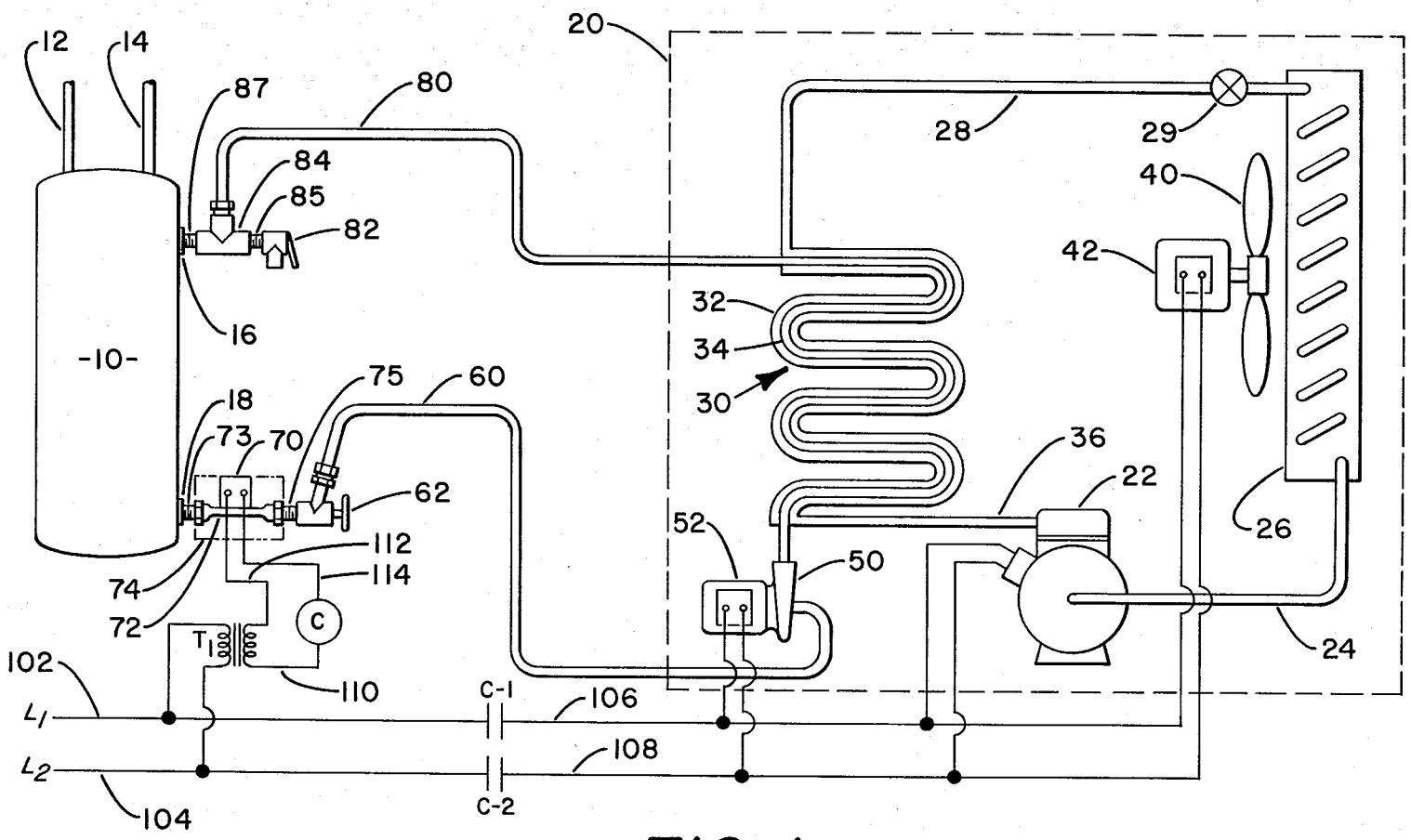
FIG. 1 is a schematic representation of a heat pump water heater combined with a hot water tank.

It is further to be understood that the brief electrical schematic included as a portion of FIG. 1 is not intended to show the entire electrical schematic of the heat pump water heater unit. Items such as overtemperature sensors and low pressure switches on the refrigeration circuit have been omitted for the sake of clarity.

Referring now to FIG. 1 there may be seen a schematic view of a heat pump water heater added on to a water tank. Water tank 10 is shown having hot water outlet 12, cold water inlet 14, relief outlet 16 and drain outlet 18. Heat pump water heater unit 20 includes the elements contained within the dotted lines. The heat pump water heater unit includes a refrigeration circuit having motor compressor unit 22 connected by discharge line 36 to condenser 30. Condenser 30 includes a refrigerant path 32 and a water path 34. This condenser may typically be a tube in tube heat exchanger. Condenser 30 is joined by interconnecting line 28 and expansion device 29 to evaporator 26. Evaporator 26 is connected by suction line 24 to the motor compressor unit 22 to complete the refrigeration circuit. Evaporator fan 40, powered by fan motor 42, is shown located to circulate ambient air in heat exchange relation with evaporator 26. Pump 50 is shown positioned to be driven by pump motor 52 to circulate water through the water flow path. Although shown as a direct drive impeller, it is to be understood that this pump may include other types of water circulating means and may be coupled between the motor and impeller magnetically.

The water flow path from the water tank through the heat pump water heater unit and back to the water tank includes nipple 73 connected to drain outlet 18 of the water tank. Connected to nipple 73 is a flattened tube 72 which is connected via nipple 75 to drain valve 62. Attached to drain valve 62 is inlet hose 60 which is connected to pump 50 which is connected to water path 34 of condenser 30. The outlet of water path 34 is connected to outlet hose 80 which is connected through tee 84 and nipple 87 to relief outlet 16 of the water tank to complete the circuit. Additionally, connected to tee 84 is nipple 85 which is connected to the pressure and temperature relief valve 82 which is designed to open should the pressure or temperature of the water in the tank or the system exceed a predetermined maximum value. Additionally, shown mounted to flat tube 72 is thermostat 70 all of which is encased within insulation 74.

An electrical circuit for controlling the operation of various components is additionally shown. Power is supplied from lines L-1 and L-2 to wires 102 and 104. Wire 102 is connected to transformer T-1 and to normally open contactor contacts C-1. Wire 104 is additionally connected to the primary winding of transformer T-1 and to normally open contacts C-2. Wire 106 connects normally open contacts C-1 to the pump motor 52, fan motor 42 and to the motor of compressor motor unit 22. Wire 108 connects normally open contacts C-2 with the pump motor 52, fan motor 42 and the motor of motor compressor unit 22. The secondary of transformer T-1 is connected via wire 112 to thermostat 70 and via wire 110 to contactor C. Wire 114 additionally connects contactor C to thermostat 70.

Figure 2:
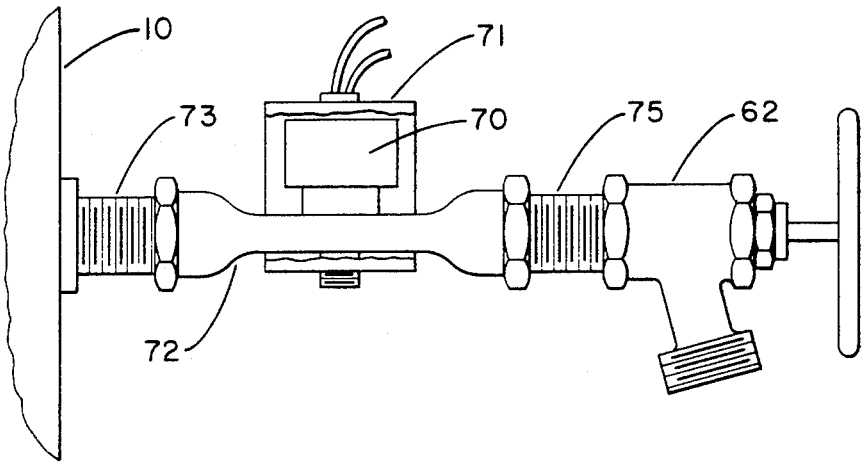
FIG. 2 is a side view of the thermally conductive tubular member and thermostat.

Referring now to FIG. 2 there can be seen an enlarged view of a portion of FIG. 1. Nipple 73 is shown connected to water tank 10 at the drain outlet. A flattened copper tube 72 is shown extending therefrom to nipple 75. Drain valve 62 to which the inlet hose 60 may be connected is shown connected to nipple 75. Thermostat 70 and the wires leading therefrom are shown mounted with a metal portion of the thermostat in contact with the flat portion of tubular member 72 such that the thermostat may sense the temperature of the tubular member. A thermostat bracket 71 is shown for securing the thermostat to the tubular member.

Figure 3:
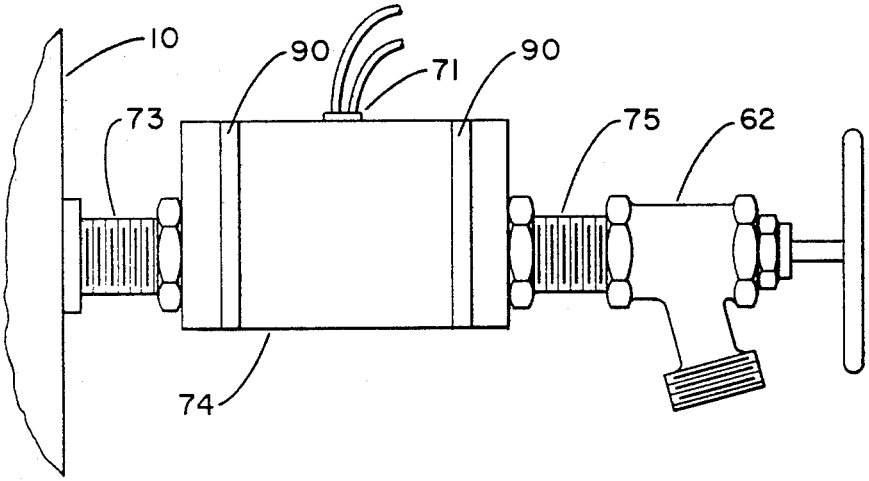
FIG. 3 is a side view identical to FIG. 2 showing the insulation placed about the tubular member and thermostat.

FIG. 3 is an identical view to FIG. 2 showing the insulation in place. This insulation is typically formed from a sheet of elastomeric foam. Bands 90 are located circumferentially about the insulation as it is wrapped about the thermostat and the tubular member to secure the insulation in place. Thermostat bracket 71 may be seen extending through an opening in the top of the sheet of insulation such that access for adjusting the thermostat may be had therethrough. The remaining components as shown in FIG. 3 are identical to those described in FIG. 2.

The provision of a thermally conductive member having a flattened portion is utilized to aid in the sensing of the water temperature within the tank. This thermally conductive member is typically copper and is located immediately adjacent the tank and connected thereto via nipple 73. The thermostat is located to sense the temperature of this thermally conductive member. When the circulating pump 50 is running the water from the tank is circulated through the tubular member and the thermostat senses that temperature directly. When the pump is not running heat energy indicative of the temperature level of the water in the tank is conducted both through the nipple and the thermally conductive material and through the water in the nipple and the thermally conductive material such that the thermostat may sense an accurate representation of the temperature level of the water within the tank. By providing insulation 74 about the tubular member and the thermostat the transfer of heat energy from the tubular member to the ambient air is reduced to further enhance the thermostat accurately sensing the temperature of the water within the tank.

The thermostat acts to energize contactor C when the temperature in the tank falls below a predetermined level. Once contactor C is energized contacts C-1 and C-2 are closed supplying power from lines L-1 and L-2 to operate pump motor 52, fan motor 42 and the motor of compressor unit 22 such that pump 50 is energized to circulate water between the hot water tank and the heat pump hot water unit, the compressor motor is energized to operate the compressor of the refrigeration circuit and fan motor 42 is energized to operate fan 40 for circulating air in heat exchange with the evaporator. The thermostat remains energized until the temperature of the water rises to a second threshold temperature. Once the water temperature reaches the second threshold temperature the thermostat opens discontinuing operation of the pump, fan motor and the motor compressor unit. The thermostat remains open until the water temperature drops a predetermined amount such as 20° F.

Hence, it can be seen that by the utilization of this thermally conductive member and thermostat combination it is possible to sense water temperature and to only energize pump motor 52 to cause circulation of the water when it is necessary to add heat energy to the water in the hot water tank.

The invention herein has been described with reference to a particular embodiment. It is to be understood by those skilled in the art that modifications and variations can be made within the spirit and scope of the invention.

What is claimed is:

1. A water heating system including a tank wherein heated water may be stored and a refrigeration circuit having a compressor, condenser and evaporator wherein the condenser includes a water passageway and a refrigerant passageway in heat exchange relation to transfer heat energy from the refrigerant to the water to be heated which comprises:

a thermally conductive tubular member extending from a bottom portion of the tank;

a first conduit connecting the tubular member to the water passageway of the condenser;

a second conduit connecting the water passageway of the condenser to the tank at a position spaced from the tubular member;

a pump for circulating water through the first conduit, the water passageway, condenser and second conduit;

thermal sensing means mounted to sense the temperature of the tubular member, said thermal sensing means being connected to energize the pump to circulate water, to energize the compressor of the refrigeration circuit when the temperature sensed is below a first threshhold temperature and to de-energize the pump and the compressor when the temperature sensed exceeds a second threshhold temperature; and insulation mounted about the thermal sensing means and the thermally conductive tubular member to reduce the heat transfer from the tubular member to the ambient air such that the temperature sensed by thermal sensing means is an accurate reflection of the temperature of the water in the tank, said insulation comprising an elastomeric foam sheet, said sheet being wrapped about said tubular member and said thermal sensing means, and further including a securing means for securing said sheet in position, and said sheet further defining an opening leading to said thermal sensing means for allowing said thermal sensing means to be adjusted without removal of said insulation.

2. The apparatus as set forth in claim 1 wherein the thermally conductive tubular member further comprises a flattened portion and wherein the thermal sensing means is a thermostat mounted to the tubular member at the flattened portion.

3. The apparatus as set forth in claim 1 wherein the pump for circulating water is located between the first conduit and the condenser.

4. The apparatus as set forth in claim 1 wherein the water tank includes a drain outlet located toward the bottom thereof and wherein the thermally conductive tubular member comprises a nipple threadably fastened to the drain outlet and a copper tube having a flattened portion attached thereto.

5. The apparatus as set forth in claim 1 wherein said securing means comprises circumferential extending bands for securing the sheet in position.

6. A method of controlling a water heating unit including a refrigeration circuit for transferring heat energy to water, a water tank wherein hot water is stored, conduits connecting the water tank to the water heating unit and a circulating pump for routing water through the conduits and between the water tank and the water heating unit which comprises the steps of:

sensing the temperature of the water in the tank to determine if the heating unit need be energized to supply additional heat energy, said sensing including mounting a thermally conductive tubular member to a drain outlet in the tank as a portion of one of the conduits and mounting a thermal sensing means thereto, and detecting the temperature of said member by said thermal sensing means, which is representative of the temperature of the water in the tank, said sensing further including insulating said thermally conductive tubular member and said thermal sensing means from ambient air by wrapping said thermally conductive tubular member and said thermal sensing means in an elastomeric foam insulation such that said tubular member and said thermal sensing means have a temperature level representative of the temperature of the water in the tank.

7. The method as set forth in claim 6 and further comprising the step of de-energizing the circulating pump and the refrigeration circuit upon the step of sensing ascertaining that the water temperature in the tank is at a sufficient level.

* * * * *